US009899763B2

(12) United States Patent
Zheng et al.

(10) Patent No.: US 9,899,763 B2
(45) Date of Patent: Feb. 20, 2018

(54) INDUSTRIAL PLUG USED FOR MARINE CONTAINER

(71) Applicant: YUEQING HENGTONG ELECTRIC CO.,LTD, Yueqing (CN)

(72) Inventors: Jinyu Zheng, Yueqing (CN); Quan Liu, Yueqing (CN)

( * ) Notice: Subject to any disclaimer, the term of this patent is extended or adjusted under 35 U.S.C. 154(b) by 0 days.

(21) Appl. No.: 15/675,774

(22) Filed: Aug. 13, 2017

(65) Prior Publication Data

US 2017/0346214 A1 Nov. 30, 2017

Related U.S. Application Data

(63) Continuation of application No. PCT/CN2015/087212, filed on Aug. 17, 2015.

(30) Foreign Application Priority Data

Feb. 13, 2015 (CN) ..... 2015 1 0078535

(51) Int. Cl.
*H01R 13/512* (2006.01)
*H01R 13/514* (2006.01)

(52) U.S. Cl.
CPC ..... *H01R 13/512* (2013.01); *H01R 13/514* (2013.01)

(58) Field of Classification Search
CPC ..... H01R 13/512; H01R 13/514
USPC ..... 439/544
See application file for complete search history.

(56) References Cited

U.S. PATENT DOCUMENTS 5,496,194 A * 3/1996 Huss, Jr. ..... H01R 13/4365 439/595
5,730,624 A * 3/1998 Lester ..... H01R 13/424 439/595
6,764,351 B2 * 7/2004 Finzer ..... F16B 29/00 439/752
7,101,192 B1 * 9/2006 Bordeau ..... H01R 13/4364 439/66
7,351,117 B1 * 4/2008 Mostoller ..... H01R 13/428 439/744

(Continued)

FOREIGN PATENT DOCUMENTS

CN 201174485 Y 12/2008
CN 201194283 Y 2/2009

(Continued)

*Primary Examiner* — Alexander Gilman
(74) *Attorney, Agent, or Firm* — Wayne & Ken, LLC; Tony Hom

(57) ABSTRACT

The disclosure discloses an industrial plug for a marine container, including a plug base. A plug sealing sheath component is screwed to an upper end of the plug base. An insertion core fixing plate is sleeved on the plug base. A plurality of wiring insertion core components are arranged on the insertion core fixing plate. A rotary braking pin penetrates through a central through hole from bottom to top. The rotary braking pin includes a braking pin base and a rotary base. A first and a second clamping grooves are respectively formed at an interval in an inner side of the plug base. The braking stopping block is lifted upwards and rotated to drive the rotary clamping block to switch between the two clamping grooves. The industrial plug is simple and flexible in switching, and has strong universality.

8 Claims, 11 Drawing Sheets

(56) References Cited

U.S. PATENT DOCUMENTS

| | | | | |
|---|---|---|---|---|
| 7,578,708 | B2 * | 8/2009 | Hachadorian | H01R 13/447 439/736 |
| 8,029,322 | B1 * | 10/2011 | Oh | H01R 13/426 439/695 |
| 8,241,068 | B2 * | 8/2012 | Millard | H01R 13/6461 439/320 |
| 8,974,243 | B2 * | 3/2015 | Friese | H01R 13/4367 439/374 |
| 9,142,914 | B2 * | 9/2015 | Jozwik | H01R 13/622 |
| 9,437,970 | B2 * | 9/2016 | Quero Pacheco | H01R 13/562 |
| 2003/0199205 | A1 * | 10/2003 | Kosmala | H01R 9/032 439/752 |
| 2005/0118853 | A1 * | 6/2005 | Starke | H01R 13/622 439/320 |
| 2005/0250365 | A1 * | 11/2005 | Starke | H01R 13/622 439/320 |
| 2009/0269958 | A1 * | 10/2009 | Fujiwara | H01R 13/5219 439/320 |

FOREIGN PATENT DOCUMENTS

| | | | |
|---|---|---|---|
| CN | 101626123 | A | 1/2010 |
| CN | 203150784 | U | 8/2013 |
| CN | 104638481 | A | 5/2015 |
| CN | 204441653 | U | 7/2015 |
| KR | 101225048 | B1 | 1/2013 |

* cited by examiner

INDUSTRIAL PLUG USED FOR MARINE CONTAINER

TECHNICAL FIELD

The present invention relates to an industrial plug, and more specifically, to an industrial plug for a marine container.

BACKGROUND OF THE INVENTION

On marine containers, an industrial plug serves as a common power receiving interface in a transportation process of the containers. General requirements and dimensional interchangeability requirements of the industrial plug need to meet a standard IEC60309. As shown in FIG. 1, different colors are used for displaying different rated voltages of products in the standard IEC60309. For example, a plug or a socket with a rated voltage of 380-480V AC is red. In addition, as specified in the international standard IEC60309, an industrial red plug or socket which has a rated voltage of 380V AC, 50Hz and 3P+E (3P+earthed) and has an earthing contact in a 3 h position (a 3 o'clock direction, referring to a front view of the plug for a clock position) is only used for a power receiving interface apparatus of an ISO standardized refrigerated vessel (that is, a refrigerated container). However, an industrial plug or socket product which has a rated voltage of 380-415V AC, a 50/60 Hz and 3P+E (3P +earthed) and has an earthing contact in a 6 h position (a 6 o'clock direction) is internationally applied widest and most universally.

In an international logistics transportation industry, many containers need to be under live work in the transportation process to control temperatures in the containers. Now an actual condition is that: when the containers are positioned in a place A, a power transmission interface of an industrial red socket which has a rated voltage of 380V AC, 50 Hz and 3P+E (3P+earthed) and has an earthing contact in a 3 h position (a 3 o'clock direction) is arranged in the place A, but when the containers are positioned in a place B, such a power transmission interface is not arranged in the place B, and only a power transmission interface of an industrial red socket which has a rated voltage of 380-415V AC, 50/60 Hz and 3P+E (3P+earthed) and has an earthing contact in a 6 h position (a 6 o'clock direction) is arranged. At this moment, a user has to replace the power receiving plug interface of the containers, that is, use the 6 h plug to replace the 3 h plug, thereby guaranteeing normal power supply of the containers. Great inconvenience is brought to users due to a problem of poor universality in an existing industrial plug.

SUMMARY OF THE INVENTION

A technical problem to be solved in the present invention is that an existing industrial plug is poor in universality and brings great inconvenience to customer use.

In order to solve the technical problem above, a technical solution adopted in the present invention is as follows: an industrial plug for a marine container is provided, comprising a plug base, wherein a plug sealing sheath component is screwed to an upper end of the plug base; an insertion core fixing plate is sleeved on the plug base, wherein a plurality of wiring insertion core components are arranged on the insertion core fixing plate in a surrounding manner in sequence; a plug pressing plate matched with the wiring insertion core components is sleeved at upper ends of the wiring insertion core components; a through hole is formed in a center of the insertion core fixing plate; a rotary braking pin penetrates through the through hole from bottom to top; the rotary braking pin comprises a braking pin base and a rotary base extending out of one side of the braking pin base; an outer end of the rotary base is provided with a rotary clamping block; a lower end of the braking pin base protrudes downwards to form a braking stopping block matched with the through hole; an upper end of the braking pin base protrudes upwards to form a rotary shaft; a braking compression spring is sleeved on the rotary shaft; an upper end of the rotary shaft is abutted against the plug pressing plate; a first clamping groove and a second clamping groove are respectively formed at an interval in an inner side of the plug base; a slide rail is arranged between the first clamping groove and the second clamping groove; the rotary clamping block is arranged in the first clamping groove or the second clamping groove; and the braking stopping block is lifted upwards and rotated to drive the rotary clamping block to rotate from the first clamping groove or the second clamping groove to enter the second clamping groove or the first clamping groove and further drive the wiring insertion core components to make adaptive position switching.

In the solution above, the wiring insertion core components comprise an earthing insertion core component and a plurality of live wire insertion core components, and the rotary braking pin is arranged between the earthing insertion core component and one adjacent live wire insertion core component.

In the solution above, the rotary clamping block drives the insertion core fixing plate and the plug pressing plate to rotate and further drives the earthing insertion core component to rotate; when the rotary clamping block is positioned in the first clamping groove, the earthing insertion core component is in a first position; and when the rotary clamping block is positioned in the second clamping groove, the earthing insertion core component is in a second position.

In the solution above, the first position is in a 3 o'clock direction, and the second position is in a 6 o'clock direction.

In the solution above, a threaded hole is formed in the rotary base, and a fastening bolt penetrates through the threaded hole to fix the rotary braking pin to the insertion core fixing plate.

In the solution above, the plug sealing sheath component comprises a sealing sheath body, and a locking nut and a locking ring positioned on two sides of the sealing sheath body. A wire tightening and sealing plug is sleeved in the locking nut. An O-shaped sealing ring is arranged in the locking ring. A lower end of the sealing sheath body is screwed and sleeved on the plug base.

In the solution above, an annular rib is arranged on an upper part of the plug base, and a waterproof plug sealing washer is fixedly bonded to a lower part of the annular rib through a sealant.

In the solution above, a rotary shaft sleeve is arranged on the plug pressing plate in a position corresponding to the rotary shaft; and when a lower surface of the braking stopping block is flush with a lower surface of the insertion core fixing plate, a section of gap is formed between the rotary shaft and an inner upper end surface of the rotary shaft sleeve.

According to the present invention, the rotary braking pin penetrates through the central through hole of the insertion core fixing plate from bottom to top, the first clamping groove and the second clamping groove are respectively formed at an interval in the inner side of the plug base, the slide rail is arranged between the two clamping grooves, and the rotary braking pin is lifted upwards and rotated to drive the wiring insertion core components to switch moment directions, thereby realizing multiple purposes by one object, simple and flexible switching and strong universality and bringing great convenience to customer use.

DETAILED DESCRIPTION OF THE INVENTION

The present invention is described below in detail in combination with drawings of the specification.

Figure 1:
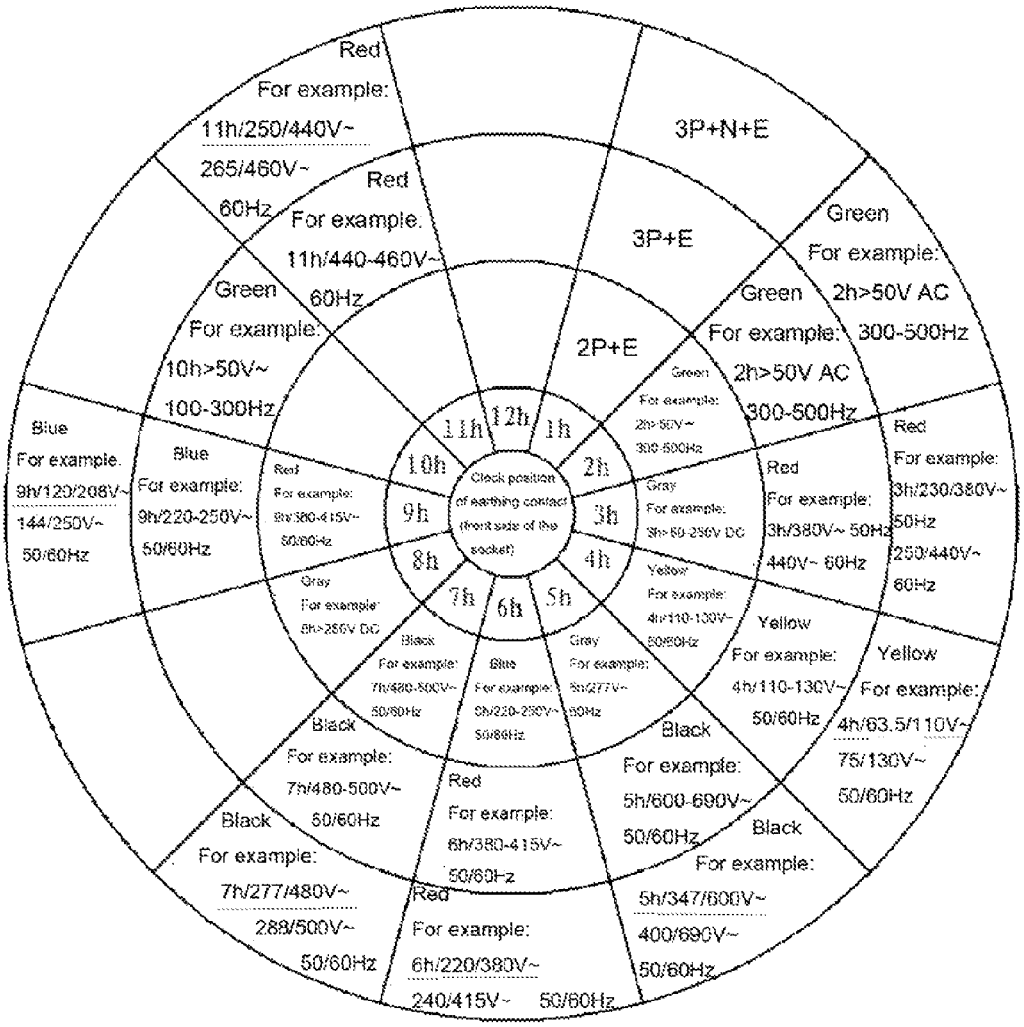
FIG. 1 is a classification diagram of voltages and colors of an industrial plug or socket in IEC60309.
Figure 5:
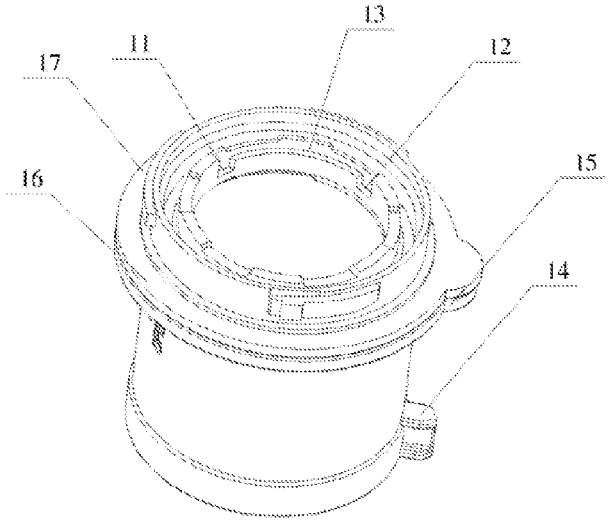
FIG. 5 is a structural schematic diagram of a plug base in the present invention.
Figure 6:
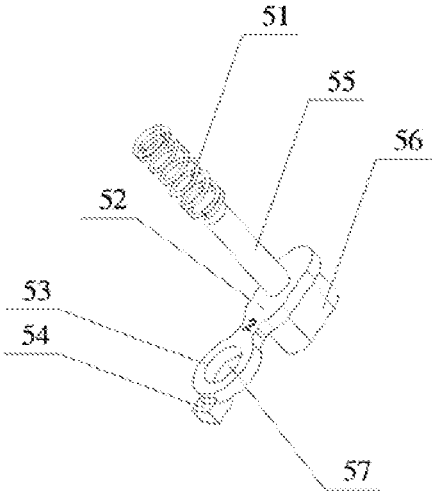
FIG. 6 is a structural schematic diagram of a rotary braking pin in the present invention.
Figure 7:
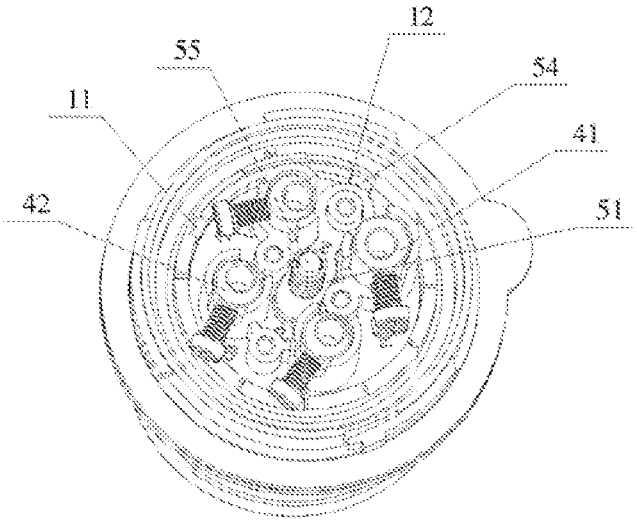
FIG. 7 is an assembly diagram of a plug base, an insertion core fixing plate and a rotary braking pin in the present invention.
Figure 8:
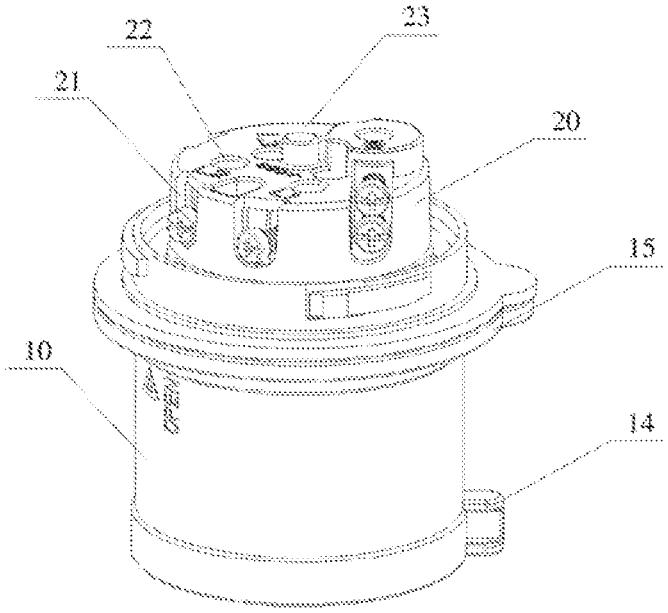
FIG. 8 is a structural schematic diagram of the present invention after disassembly of a plug sealing sheath component.
Figure 11:
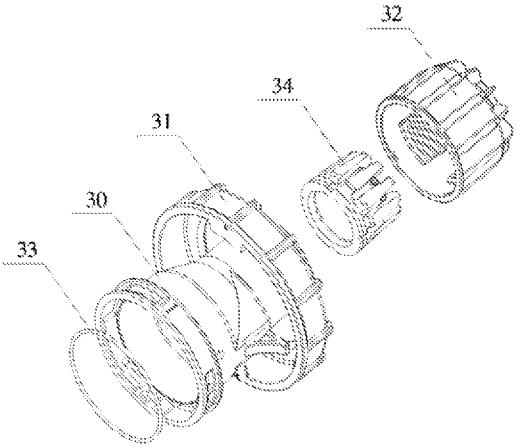
FIG. 11 is an exploded diagram of a plug sealing sheath component in the present invention.

As shown in FIG. 1, FIG. 5 and FIG. 11, the present invention provides an industrial plug for a marine container. The industrial plug comprises a plug base 10, a plug pressing plate 20, an insertion core fixing plate 40 and a plug sealing sheath component. The plug sealing sheath component is screwed to an upper end of the plug base 10 and is used for sealing and protecting the plug base 10. The plug sealing sheath component comprises a sealing sheath body 30, a locking nut 32 and a locking ring 31. The locking nut 32 and the locking ring 31 are respectively positioned on an upper part and a lower part of the sealing sheath body 30 and screwed and connected to an outer side of the sealing sheath body 30. A wire tightening and sealing plug 34 is sleeved in the locking nut 32. A sealing groove is formed in the locking ring 31 on the lower part of the sealing sheath body 30. An O-shaped sealing ring is arranged in the sealing groove. The sealing sheath body 30 and an upper end of the plug base 10 form a sealing structure through the O-shaped sealing ring. The sealing structure can achieve a sealing effect when the plug is connected with a socket. A lower end of the sealing sheath body 30 is screwed and sleeved on the plug base 10.

A plurality of first screwing ribs 17 are arranged on the plug base 10 at intervals. A plurality of second screwing ribs which can be adaptively clamped are arranged at corresponding positions on an inner side of the sealing sheath body 30. The second screwing ribs can push the first screwing ribs 17 to rotate so as to drive the plug base 10 to rotate when the sealing sheath body 30 is screwed each time. An annular rib 16 is arranged on an upper part of the plug base 10. A waterproof plug sealing washer 15 is fixedly bonded to a lower part of the annular rib 16 through a sealant.

Figure 2:
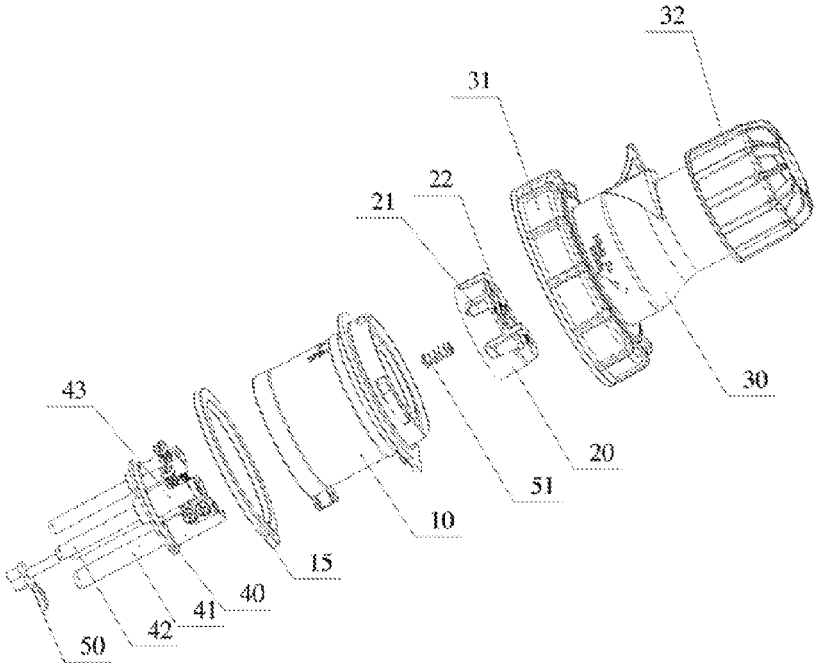
FIG. 2 is an exploded diagram of the present invention.
Figure 3:
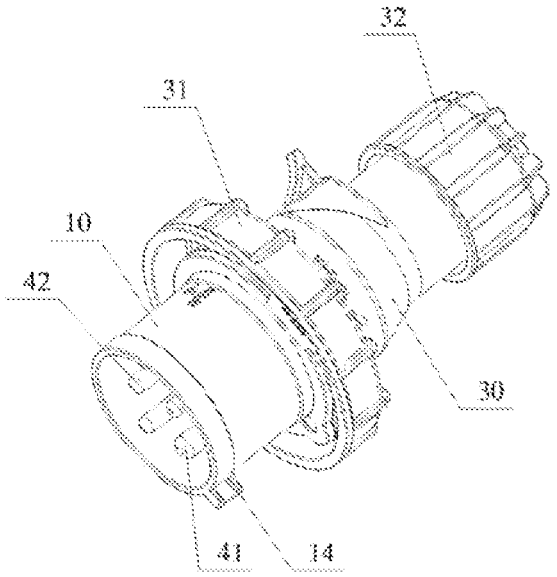
FIG. 3 is a structural schematic diagram of the present invention.
Figure 4:
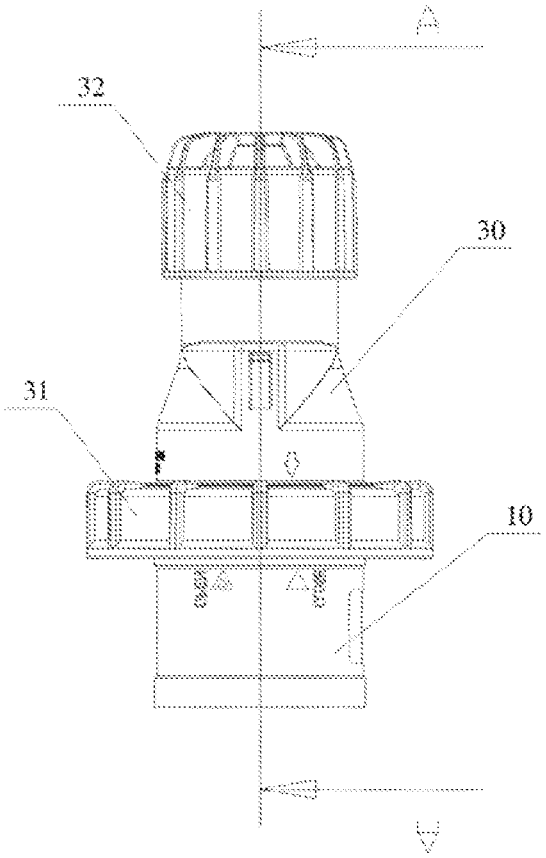
FIG. 4 is a front view of the present invention.

In combination with FIG. 2, FIG. 3 and FIG. 4, an anti-misplug convex block 14 is arranged at a lower end on an outer side of the plug base 10, and when a user inserts the industrial plug into a pin, the user can be helped to rapidly find an accurate direction by referring to a position corresponding to the anti-misplug convex block 14, thereby saving time. An insertion core fixing plate 40 is sleeved on the plug base 10. A plurality of wiring insertion core components are arranged on the insertion core fixing plate 40 in a surrounding manner in sequence. The wiring insertion core components comprise an earthing insertion core component 41 and a plurality of live wire insertion core components 42, wherein the earthing insertion core component 41 is used for connecting an earth wire, and the live wire insertion core components 42 are used for connecting a live wire. In the present invention, the quantity of the live wire insertion core components 42 is three, and a position of the earthing insertion core component 41 determines whether the industrial plug is in a 3 h position (a 3 o'clock direction) or a 6 h position (a 6 o'clock direction). An annular protection plate 43 is arranged on the insertion core fixing plate 40 in a position corresponding to each of the wiring insertion core components. A slotted hole is formed in a side surface on an upper part of each annular protection plate 43. The wiring insertion core components penetrate through the slotted holes and are fixed to the insertion core fixing plate 40 through screws.

In combination with FIG. 5, FIG. 6, FIG. 7, FIG. 8 and FIG. 9, a plug pressing plate 20 matched with the wiring insertion core components is sleeved at an upper end of the wiring insertion core components. A matched notch 21 is formed in the plug pressing plate 20 in a position corresponding to the slotted hole in each annular protection plate 43, so as to facilitate assembly and disassembly of the screw. A matched round hole 22 is formed in the plug pressing plate 20 in a position corresponding to an upper end of each of the wiring insertion core components, so as to facilitate wiring. A through hole is formed in the center of the insertion core fixing plate 40. A rotary braking pin 50 penetrates through the through hole from bottom to top. The rotary braking pin 50 is arranged between the earthing insertion core component 41 and one adjacent live wire insertion core component 42.

The rotary braking pin 50 comprises a braking pin base 52 and a rotary base 53 extending out of one side of the braking pin base 52. An outer end of the rotary base 53 is provided with a rotary clamping block 54. A lower end of the braking pin base 52 protrudes downwards to form a braking stopping block 56 matched with the through hole in the center of the insertion core fixing plate 40. The braking stopping block 56 can slide up and down in the through hole in the center of the insertion core fixing plate 40. A threaded hole 57 is formed in the rotary base 53, and a fastening bolt penetrates through the threaded hole 57 to fix the rotary braking pin 50 to the insertion core fixing plate 40. Therefore, when the rotary braking pin 50 rotates, the plug pressing plate 20 and the insertion core fixing plate 40 can be simultaneously driven to rotate.

Figure 10:
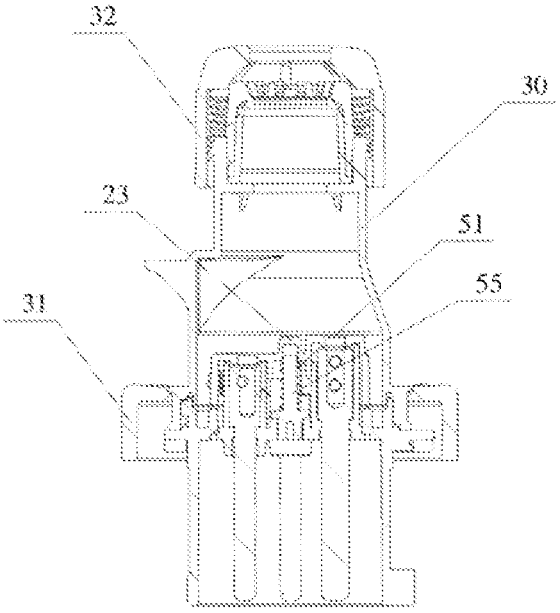
FIG. 10 is a sectional view of FIG. 3 along A-A direction.

In combination with FIG. 10, an upper end of the braking pin base 52 protrudes upwards to form a rotary shaft 55. A braking compression spring 51 is sleeved on the rotary shaft 55. An upper end of the rotary shaft 55 is abutted against the plug pressing plate 20. A rotary shaft sleeve 23 is arranged on the plug pressing plate 20 in a position corresponding to the rotary shaft 55. When a lower surface of the braking stopping block 56 is flush with a lower surface of the insertion core fixing plate 10, a section of gap is formed between the rotary shaft 55 and an inner upper end surface of the rotary shaft sleeve 23, and the rotary shaft 55 can move up and down in the gap.

A first clamping groove 11 and a second clamping groove 12 are respectively formed at an interval in an inner side of the plug base 10. A slide rail 13 is arranged between the first clamping groove 11 and the second clamping groove 12. The rotary clamping block 54 slides on the slide rail 13 and can enter the second clamping groove 12 from the first clamping groove 11 or enter the first clamping groove 11 from the second clamping groove 12. When the rotary clamping block 54 is arranged in the first clamping groove 11, a position of the earthing insertion core component 41 is in a first position, that is a 3 o'clock direction (or a 6 o'clock direction); and when the rotary clamping block 54 slides into the second clamping groove 12, the earthing insertion core component 41 is rotated to a second position. According to the present invention, the first position is preferably the 3 o'clock direction, and the second position is preferably the 6 o'clock direction. By switching the positions of the rotary clamping block 54, the earthing insertion core component 41 can be flexibly switched between the 3 o'clock direction and the 6 o'clock direction.

Figure 9:
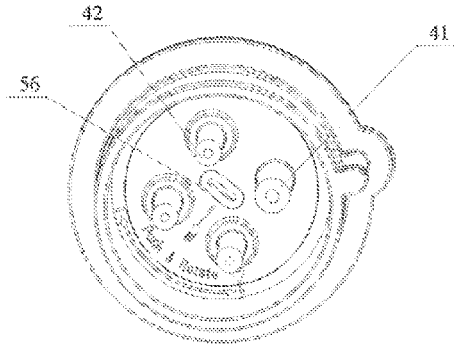
FIG. 9 is a rear view of FIG. 7.

In combination with FIG. 3 and FIG. 9, when the rotary clamping block 54 is switched, the braking stopping block 56 only needs to be slightly lifted upwards by a certain distance by virtue of a screwdriver or other external force, the braking stopping block 56 is simultaneously rotated to drive the rotary braking pin 50 to rotate, and the rotary clamping block 54 is further driven to rotate to enter the second clamping groove 12 (or the first clamping groove 11) from the first clamping groove 11 (or the second clamping groove 12), thereby completing switching of the positions of the rotary clamping block 54. Because gaps exist among the plug pressing plate 20, the insertion core fixing plate 40 and inner walls of the plug base 10, the rotary braking pin 50 is rotated to simultaneously drive the plug pressing plate 20 and the insertion core fixing plate 40 to rotate, and also drive the earthing insertion core component 41 to switch from the 3 o'clock direction (or the 6 o'clock direction) to the 6 o'clock direction (or the 3 o'clock direction). After switching is ended, the screwdriver is loosened and the braking stopping block 56 is returned to an original position under an effect of a restoring force of the compression spring 51. The industrial plug is simple and convenient in operation and has very high practical value.

According to the present invention, the rotary braking pin penetrates through the central through hole of the insertion core fixing plate from bottom to top, the first clamping groove and the second clamping groove are respectively formed at an interval in the inner side of the plug base, the slide rail is arranged between the two clamping grooves, and the rotary braking pin is lifted upwards and rotated to drive the wiring insertion core components to switch moment directions, thereby realizing multiple purposes by one object, simple and flexible switching and strong universality and bringing great convenience to customer use.

The present invention is not limited to the optimal embodiments above. Any person should know structural changes made under an inspiration of the present invention and all technical solutions which are the same as or close to those in the present invention should be included in the protection scope of the present invention.

What is claimed is:

1. An industrial plug for a marine container, comprising a plug base, wherein a plug sealing sheath component is screwed to an upper end of the plug base; an insertion core fixing plate is sleeved on the plug base, wherein a plurality of wiring insertion core components are arranged on the insertion core fixing plate in a surrounding manner in sequence; a plug pressing plate matched with the wiring insertion core components is sleeved at upper ends of the wiring insertion core components; a through hole is opened in a center of the insertion core fixing plate; a rotary braking pin penetrates through the through hole from bottom to top; the rotary braking pin comprises a braking pin base and a rotary base extending out of one side of the braking pin base; an outer end of the rotary base is provided with a rotary clamping block; a lower end of the braking pin base protrudes downwards to form a braking stopping block matched with the through hole; an upper end of the braking pin base protrudes upwards to form a rotary shaft; a braking compression spring is sleeved on the rotary shaft; an upper end of the rotary shaft is abutted against the plug pressing plate; a first clamping groove and a second clamping groove are respectively formed at an interval in an inner side of the plug base; a slide rail is arranged between the first clamping groove and the second clamping groove; the rotary clamping block is arranged in the first clamping groove or the second clamping groove; and the braking stopping block is lifted upwards and rotated to drive the rotary clamping block to rotate from the first clamping groove or the second clamping groove to enter the second clamping groove or the first clamping groove and further drive the wiring insertion core components to make adaptive position switching.

2. The industrial plug for the marine container according to claim 1, wherein the wiring insertion core components comprise an earthing insertion core component and a plurality of live wire insertion core components, and the rotary braking pin is arranged between the earthing insertion core component and one adjacent live wire insertion core component.

3. The industrial plug for the marine container according to claim 2, wherein the rotary clamping block drives the insertion core fixing plate and the plug pressing plate to rotate and further drives the earthing insertion core component to rotate; when the rotary clamping block is positioned in the first clamping groove, the earthing insertion core component is in a first position; and when the rotary clamping block is positioned in the second clamping groove, the earthing insertion core component is in a second position.

4. The industrial plug for the marine container according to claim 3, wherein the first position is in a 3 o'clock direction, and the second position is in a 6 o'clock direction.

5. The industrial plug for the marine container according to claim 1, wherein a threaded hole is opened in the rotary base, and a fastening bolt penetrates through the threaded hole to fix the rotary braking pin to the insertion core fixing plate.

6. The industrial plug for the marine container according to claim 1, wherein the plug sealing sheath component comprises a sealing sheath body, and a locking nut and a locking ring positioned on two sides of the sealing sheath body; a wire tightening and sealing plug is sleeved in the locking nut; an O-shaped sealing ring is arranged in the locking ring; and a lower end of the sealing sheath body is screwed and sleeved on the plug base.

7. The industrial plug for the marine container according to claim 1, wherein an annular rib is arranged on an upper part of the plug base, and a waterproof plug sealing washer is fixedly bonded to a lower part of the annular rib through a sealant.

8. The industrial plug for the marine container according to claim 1, wherein a rotary shaft sleeve is arranged on the plug pressing plate in a position corresponding to the rotary shaft; and when a lower surface of the braking stopping block is flush with a lower surface of the insertion core fixing plate, a section of gap is formed between the rotary shaft and an inner upper end surface of the rotary shaft sleeve.

* * * * *